US006913530B2

(12) United States Patent
Morris et al.

(10) Patent No.: US 6,913,530 B2
(45) **Date of Patent: *Jul. 5, 2005**

(54) PRECIPITATION RESISTANT RIDGE VENT

(75) Inventors: Richard J. Morris, Prior Lake, MN (US); Scott Charles VanWey, Crystal, MN (US)

(73) Assignee: Liberty Diversified Industries, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/636,178

(22) Filed: Aug. 7, 2003

(65) Prior Publication Data

US 2004/0029523 A1 Feb. 12, 2004

Related U.S. Application Data

(63) Continuation of application No. 10/209,851, filed on Jul. 31, 2002, now Pat. No. 6,623,354, and a continuation of application No. 09/651,071, filed on Aug. 30, 2000, now Pat. No. 6,450,882.

(51) Int. Cl.[7] ..... F24F 7/00

(52) U.S. Cl. ..... 454/365; 52/199

(58) Field of Search ..... 454/364, 365, 454/366; 52/57, 199

(56) References Cited

U.S. PATENT DOCUMENTS

| | | | | | |
|---|---|---|---|---|---|
| 3,949,657 | A | * | 4/1976 | Sells | 454/365 |
| 4,817,506 | A | | 4/1989 | Cashman | |
| 4,876,950 | A | | 10/1989 | Rudeen | |
| 4,942,699 | A | | 7/1990 | Spinelli | |
| 5,022,314 | A | * | 6/1991 | Waggoner | 454/250 |
| 5,095,810 | A | * | 3/1992 | Robinson | 454/365 |
| 5,167,579 | A | | 12/1992 | Rotter | |
| 5,352,154 | A | | 10/1994 | Rotter et al. | |
| 5,425,672 | A | | 6/1995 | Rotter | |
| 5,561,953 | A | | 10/1996 | Rotter | |
| 5,651,734 | A | | 7/1997 | Morris | |
| 5,673,521 | A | | 10/1997 | Coulton et al. | |
| 5,704,834 | A | | 1/1998 | Sells | |
| 5,803,805 | A | | 9/1998 | Sells | |
| 5,830,059 | A | | 11/1998 | Sells | |
| 5,902,432 | A | | 5/1999 | Coulton et al. | |
| 5,934,995 | A | | 8/1999 | Morris et al. | |
| 5,947,817 | A | | 9/1999 | Morris et al. | |
| 6,149,517 | A | * | 11/2000 | Hansen | 454/365 |
| 6,212,833 | B1 | | 4/2001 | Henderson | |
| 6,298,613 | B1 | * | 10/2001 | Coulton et al. | 52/199 |
| 6,308,472 | B1 | * | 10/2001 | Coulton et al. | 52/198 |
| 6,357,193 | B1 | | 3/2002 | Morris | |
| 6,447,392 | B1 | | 9/2002 | Henderson | |
| 6,450,882 | B1 | * | 9/2002 | Morris et al. | 454/365 |
| 6,487,826 | B1 | | 12/2002 | McCorsley et al. | |
| 6,578,325 | B2 | | 6/2003 | Henderson | |
| 6,623,354 | B2 | * | 9/2003 | Morris et al. | 454/365 |

FOREIGN PATENT DOCUMENTS

| | | | |
|---|---|---|---|
| DE | 19821035 A1 | * | 11/1999 |
| DE | 29912644 U1 | * | 12/1999 |
| GB | 2186898 A | * | 8/1987 |
| WO | WO 84/02970 | * | 8/1984 |

OTHER PUBLICATIONS

Complaint for Patent Infringement, filed Jan. 8, 2004, U.S. District Court, District of Minnesota.

Answer and Counterclaim, filed Apr. 5, 2004, U.S. District Court, District of Minnesota.

* cited by examiner

*Primary Examiner*—Jiping Lu

(74) *Attorney, Agent, or Firm*—Patterson, Thuente, Skaar & Christensen, P.A.

(57) ABSTRACT

A precipitation resistant ventilator for a structure enclosing an interior space. The ventilator encloses a space that is in communication with the structure interior space. A thin sheet of air permeable water resistant material is disposed within the ventilator interior. The thin sheet of air permeable water resistant material forms a barrier that excludes the entry of precipitation and other foreign matter into the roof structure while still allowing air exchange.

33 Claims, 5 Drawing Sheets

PRECIPITATION RESISTANT RIDGE VENT

RELATED APPLICATION

This application is a continuation of application Ser. No. 10/209,851 filed Jul. 31, 2002 now U.S. Pat. No. 6,623,354 and application Ser. No. 09/651,071 filed Aug. 30, 2000 now U.S. Pat. No. 6,450,882.

FIELD OF THE INVENTION

The present invention relates to roof ventilators folded from a blank of corrugated plastic sheet material having a top panel and two vent panels. More particularly, it relates to a roof vent of corrugated construction including an internal filtering material to exclude precipitation, debris and vermin from entry into the vented roof.

BACKGROUND OF THE INVENTION

It is a common practice in the construction of structures to ventilate gable roofs by providing a vent along the roof ridge. Ventilation apertures are formed in the construction process by leaving or cutting an open slot along the ridge through the sheathing material covering the roof. Heated air rises and escapes at the ridge taking with it moisture that may have accumulated within the roof. The flow of wind over the ridge of the roof assists in the extraction of moisture and heated air by creating a zone of relatively reduce pressure as it crosses the ridge. Soffit vents enable the entry of fresh exterior air into the roof to replace air that has left through the ridge vent. Soffit vents are openings in the soffit material covering the undersides of the overhanging eaves of the roof.

Ideally, a ventilated roof provides for an unrestricted outflow of air through the ridge vent and inflow through the soffit vents. However, without protection of the ventilating openings, wind blown precipitation, debris and insects enter the roof and encourage damage to the structure through mildew, rot and infestation. A ventilated cap is therefore placed over the open slot in the ridge and attached to the roof along each side.

Therefore, many types of vent caps have been developed in an effort to provide free flow of air while excluding rain, snow and insects. Louvers, baffles and screens have been standard features of roof vents for decades.

Snow, in particular, is a great concern. It has a small particle size and is lightweight. Wind can carry snow upward and into roof vents readily. Snow particles may bypass louvers and deflectors that prevent the entry of most rain. As much as two feet of wind driven snow has been reported to have passed through roof vents and accumulated inside roof structures.

A number of ridge vent caps employ filtering material to restrict the entry of precipitation and foreign matter. Filtering materials include porous foams and fibrous materials. Examples of the use of porous foams include U.S. Pat. No. 5,830,059 issued to Sells, U.S. Pat. No. 5,673,521 issued to Coulton et al. and U.S. Pat. No. 4,876,950 issued to Rudeen. Both closed cell foams and open cell foams have been utilized. Open cell foams have the benefit of allowing greater airflow but tend to absorb a substantial amount of water. Closed cell foams absorb little water but restrict airflow to a greater degree. Foam products, in general, tend to deteriorate with age and exposure to the elements.

Fibrous materials enjoy wider use as roof vent filters. Examples include U.S. Pat. No. 5,902,432 issued to Coulton et al., U.S. Pat. No. 5,830,059 issued to Sells, U.S. Pat. Nos. 5,561,953, 5,425,672, 5,352,154, 5,167,579 all issued to Rotter. These patents and others disclose the use of mats of randomly aligned synthetic fibers to exclude vermin and the elements from roof vents. The Rotter patents disclose roof vents made entirely from mats of randomly aligned synthetic fibers. Fiber mats may suffer from compression, for example, under a snow load, and add expense and complexity to the construction of roof vents.

Another approach to preventing the entry of precipitation and foreign matter into vents is to employ check valves structured to close at a predetermined wind speed so as to stop the inflow of air and precipitation. Check valves have moving parts and are prone to the possibility of wear and blockage and when they operate ventilation is restricted. They also complicate the manufacturing process. U.S. Pat. No. 5,803,805 to Sells discloses a check valve ridge vent.

In recent years the use of corrugated plastic sheet materials to manufacture roof vents has presented to the marketplace a variety of inexpensive, strong, durable ridge vents which may be applied in sections or as a continuous roll. Ridge vents of this type are typically applied along the peak of a roof and covered by a row of shingles. They are thus referred to as "shingle over roof vents." Some have sufficient structural integrity such that they can be fastened to the roof with a pneumatic nail gun without crushing the vent.

Examples of corrugated plastic ridge vents include U.S. Pat. No. 5,651,734 issued to Morris, U.S. Pat. No. 5,934,995 to Morris, Kasner and Stoll and U.S. Pat. No. 5,947,817 to Morris, Gosz and Stoll which are incorporated herein in their entirety by reference.

Wind deflectors are sometimes installed along with the vent in order to restrict the entry of rain and snow into the vent. The installation of wind deflectors requires an additional step in the installation process with an attendant increase in time and expense.

The applicant is aware of a single example of a corrugated ridge vent employing a filtering material to exclude precipitation and the like. U.S. Pat. No. 5,704,834 issued to Sells discloses the use of a flexible, air permeable, moisture repelling, woven or nonwoven fabric covering the outer side of the vent passages to resist the penetration of moisture into the vent passages. The fabric filter is held in place by a perforated metal flashing attached either to the roof or to the vent.

Considerable complexity is added to the manufacturing process in order to incorporate the flashing into the vent. The presence of a rigid or semi rigid flashing may also prevent or complicate the rolling of the vent for transport and reduce ease of application. Additionally, the filtering fabric is exposed to the elements. Sun and wind may accelerate its deterioration.

It would be desirable to produce a ridge vent of folded corrugated plastic construction that effectively excludes wind blown precipitation and other foreign matter. The process of manufacturing the ridge vent should be as simple as possible. It would be preferable for such a ridge vent to require no flashing to support the filtering material. The ridge vent would ideally be possible to produce either in a continuous roll or in discrete sections. It would be preferable that filtering material be protected from exposure to the elements to maximize its life.

SUMMARY OF THE INVENTION

The present invention largely solves the above problems by providing a shingle over ridge vent that effectively excludes the entry of precipitation and foreign matter into the roof space. The ridge vent is sturdy, easily manufactured and readily installed. In addition, the filtering material that excludes precipitation is protected from factors that speed its deterioration.

The ridge vent is constructed of corrugated weather resistant material having a convoluted intermediate ply. Airflow passages in the convoluted layer are linearly oriented generally perpendicular to the long axis of the ridge vent.

The material is cut and scored so that it may be folded to have a single top panel extending its entire length. At either side of and below the top panel a plurality of folds create a plurality of stacked layers of the corrugated material with a plurality of airflow passages therethrough. A routed groove may extend the length of the bottom side of the top panel of the ridge vent to facilitate bending the ridge vent to conform to different roof pitches and to provide an additional exit path for air flowing out of the ridge vent.

A sheet of air permeable, water resistant, woven or nonwoven fabric or other membrane is applied to the bottom side of the vent. The filtering fabric is bonded to the corrugated material in the vicinity of the peak of the vent and on the bottom sides of the stacked, corrugated vent material. When the ridge vent is applied to the roof ridge the filtering fabric forms a tent like structure such that any accumulated rainwater drains out through the bottommost layer of the stacked side vent portions of the ridge vent.

The enclosure of the filtering fabric inside the ridge vent protects the fabric from exposure to sunlight and other factors that encourage deterioration.

The ridge vent may be produced in lengthy continuous rolls or discrete sections for installation. Discrete sections of ridge vent may be stacked flat or folded then stacked for shipping and handling. Multiple sections may be butted together end to end to cover a lengthy ridge application.

The vent material is unrolled or unfolded and disposed along the roof ridge so as to straddle the precut slot in the roof sheathing. The ridge vent may then be secured to the roof ridge with fasteners such as nails. It may be caulked as necessary. An individual skilled in the art will appreciate that if a roof is substantially irregular such as a corrugated metal roof or a tiled roof that a resilient conforming material may be placed beneath the ridge vent to provide a tight seal between the ridge vent and the roof. An end plug of resilient foam or other appropriate material may be inserted and secured in the end of the roof vent to close off the opening there. The ridge vent then may be covered with shingles nailed directly through the ridge vent into the roof sheathing.

DETAILED DESCRIPTION OF THE INVENTION

Figure 1:
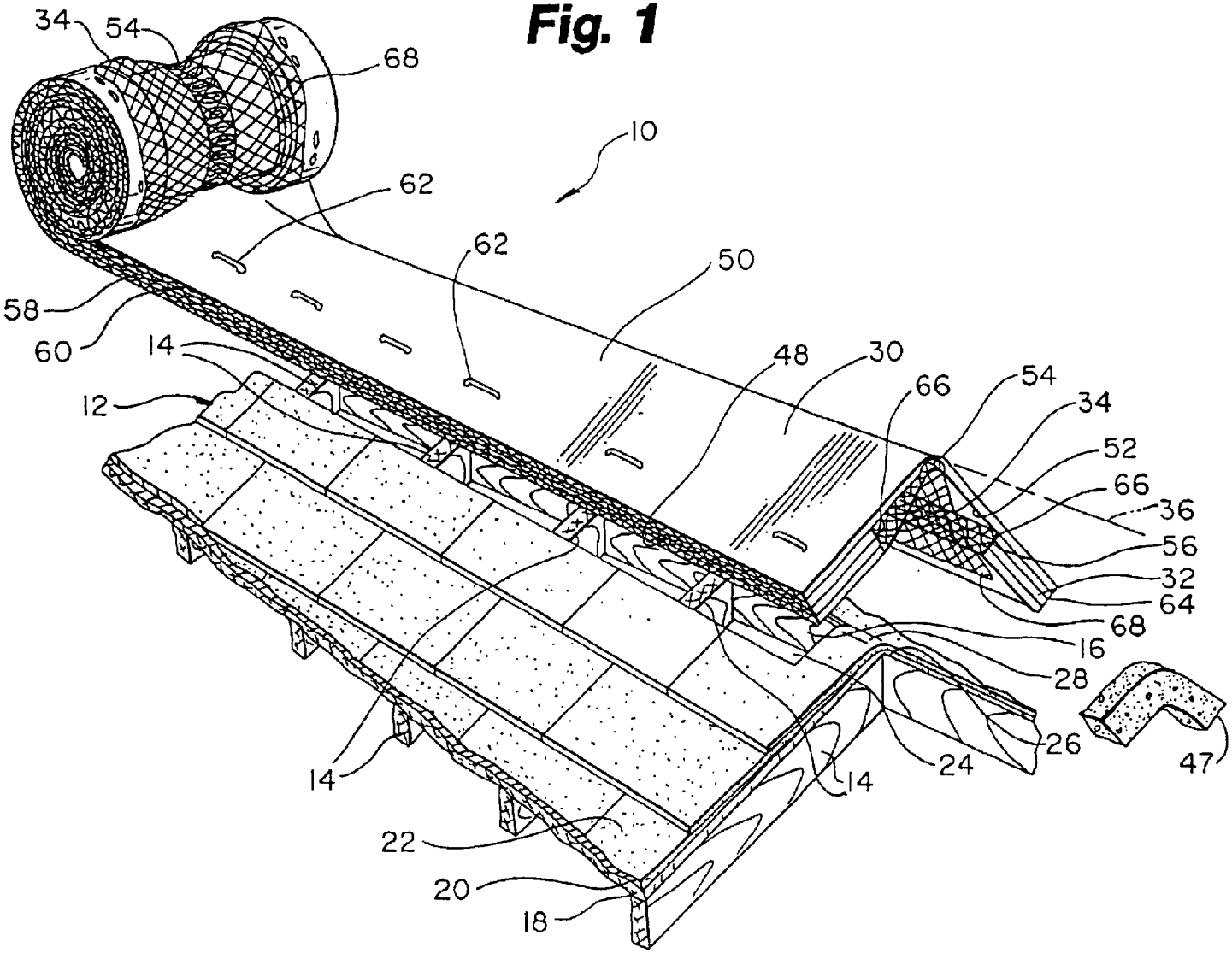
FIG. 1 is a fragmentary elevated perspective view of a ridge vent in accordance with the present invention being installed on a roof.

FIG. 1 depicts the precipitation resistant ridge cap roof vent 10 being installed on a roof 12. The roof depicted is a rafter roof, though the ridge vent 10 may be installed on many other types of roofs to provide ventilation. The roof 12 depicted includes rafters 14 secured to a ridge board 16. Rafters 14 support sheathing 18. Sheathing 18 may be of plywood, oriented strand board, planks or other suitable material secured to rafters 14. Generally sheathing 18 is overlaid with tarred felt paper 20 which is in turn overlaid with shingles 22, though other roofing materials may be employed. A cutout slot 24 is provided along the ridge 26. Slot 24 may terminate some distance from the end 28 of the ridge 26.

The ridge vent 10, as depicted in FIGS. 1, 5, 6, and 7, broadly includes a top panel 30, a plurality of vent panels 32 and filtering fabric 34. Top panel 30 presents a long axis 36 aligned generally parallel with the ridge 26 of the roof 12 when ridge vent 10 is installed. Top panel 30 and vent panels 32 are constructed of a weatherproof three ply material 38 including a generally planar top ply 40, a generally planar bottom ply 42 and an intermediate ply 44. The intermediate ply 44 defines a multiplicity of airflow passages 46 extending generally transversely to long axis 36 and entirely across top panel 30 and vent panels 32. Plug 47 may be inserted in the end of the ridge vent 10.

Figure 2:
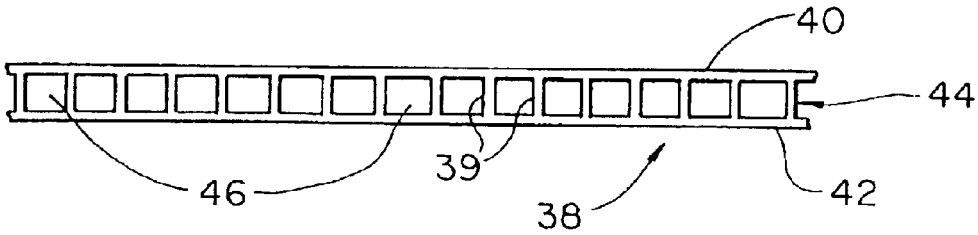
FIG. 2 is a side plan view of a three ply weatherproof material that may be used in the construction of the present invention.
Figure 3:
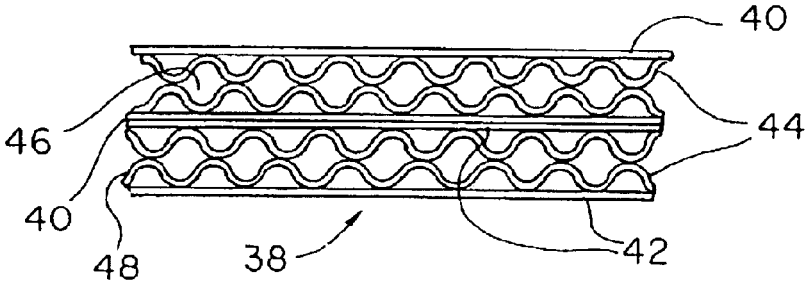
FIG. 3 is a side plan view of two layers of a three ply weatherproof material that may be used in the construction of the present invention.
Figure 4:
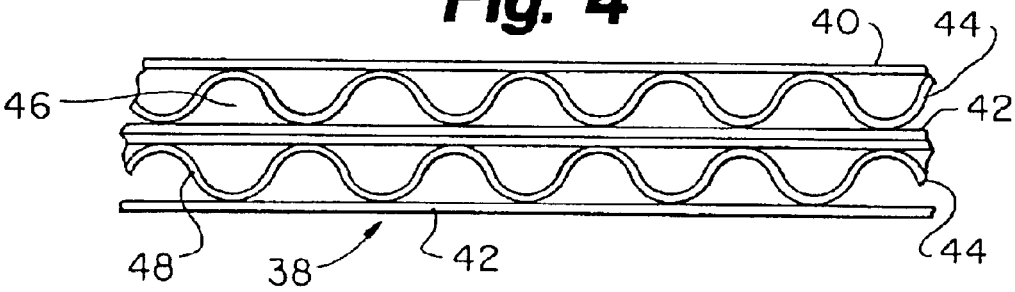
FIG. 4 is a side plan view of two layers of an alternate three ply weatherproof material that may be used in the construction of the present invention.

FIGS. 2, 3 and 4 depict several possible configurations of the three ply material 38. FIG. 2 depicts a three ply material 38 whose intermediate ply is comprised of a series of cross walls 39 connecting the top ply 40 to bottom ply 42 and defining a plurality of airflow passages 46 therebetween. FIGS. 3 and 4 depict an intermediate ply 44 of one or several convoluted or fluted layers 48 defining a plurality of airflow passages 46. FIGS. 3 and 4 also show how multiple layers of three ply material 38 may be stacked to provide many generally parallel airflow passages 46 therethrough.

Top panel 30 also presents an exterior surface 50 and an interior surface 52. Interior surface 52 may include a routed groove 54 usually extending generally parallel to long axis 36. Routed groove 54 extends through bottom ply 42 and into intermediate ply 44 defining inner openings 56 of airflow passages 46. The outer edges 58 of top panel 30 define the outer openings 60 of airflow passages 46.

Figure 5:
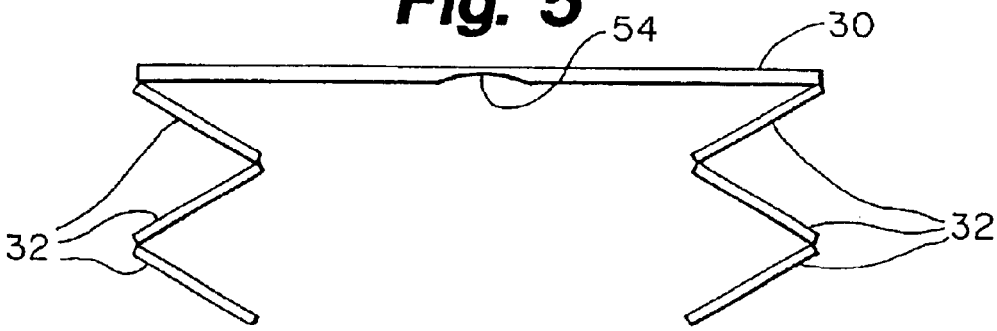
FIG. 5 is an end plan view of the ridge vent of FIG. 1 depicting a folding scheme for the hinge panels forming the lateral vents of the present invention.
Figure 6:
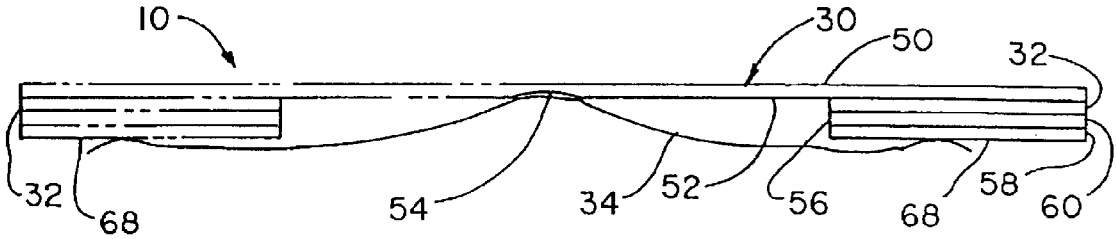
FIG. 6 is an end plan view of an embodiment of the present invention as stored and shipped in a flat configuration.

Vent panels 32 are disposed under the outer edges 58 of top panel 30 in a stacked fashion. They contain a multiplicity of airflow passages 46 oriented generally transverse to long axis 36. Vent panels 32 may be formed by scoring and folding a sheet of three ply material 38 as depicted in FIG. 5. Vent panels 32 may then be secured to top panel 30 by the use of adhesives or fasteners 62 such as staples.

Alternately, vent panels 32 may by cut separately and stacked beneath the outer edges 58 of top panel 30 and secured together and to top panel 30 with fasteners 62 or adhesive. Thus airflow passages 46 are formed extending from exterior edges 64 to interior edges 66 of vent panels 32.

Filtering fabric 34 is secured along the interior surface 52 of top panel 30, preferably in the region of the routed groove 54, and on the bottom side 68 of the lowermost vent panel 32 extending the length of the ridge vent 10. Adhesives, fasteners, heat fusing or any other suitable technique may secure filtering fabric 34 to the ridge vent 10.

Filtering fabric 34 may be of any thin, air permeable, water resistant, sheet material. Woven or nonwoven fabrics may be employed as well as air permeable water resistant membranes that are not of fabric. Preferably, filtering fabric 34 allows passage of about 75 percent of the air that would flow were it not present. The filtering fabric 34 may be a nonwoven spunbonded material of randomly arranged synthetic polymer fibers.

Figure 7:
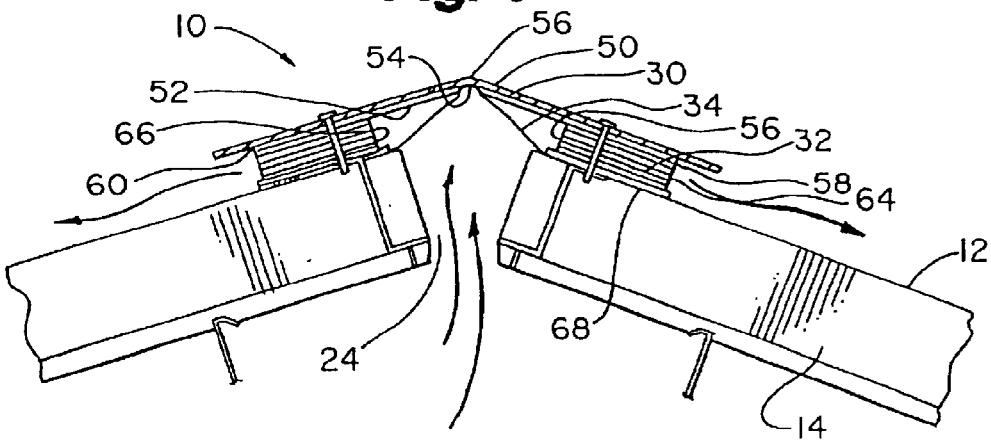
FIG. 7 is an end sectional view an embodiment of the ridge vent installed on a roof ridge.
Figure 6A:
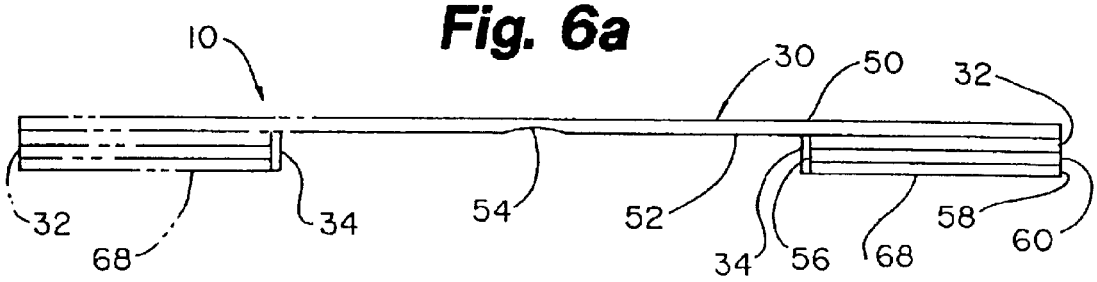
FIG. 6*a* is an end plan view of an alternate embodiment of the present invention as stored and shipped in a flat configuration.
Figure 7A:
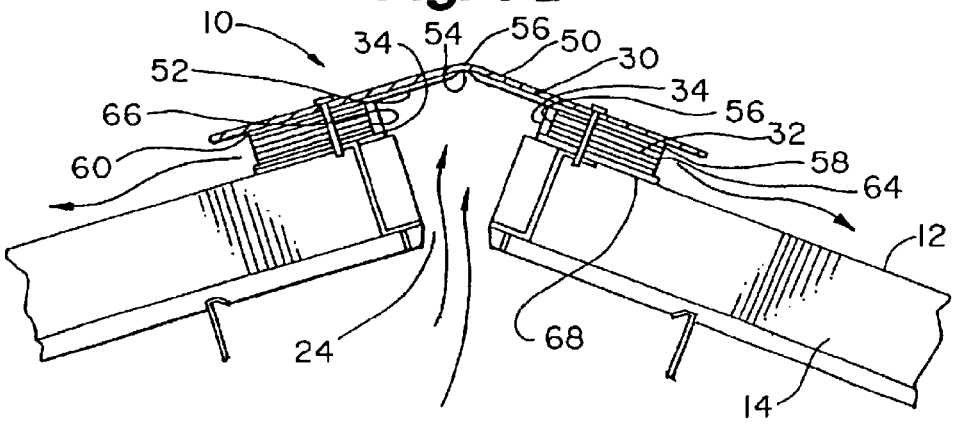
FIG. 7*a* is an end sectional view an alternate embodiment of the ridge vent installed on a roof ridge.

Referring to FIGS. 6*a* and 7*a*, in an alternate embodiment of ridge vent 10 filtering fabric 34 may be applied directly over inner openings 56 of airflow passages 46. Filtering fabric 34 may cover only interior edges 64 of vent panels 32.

Figure 6B:
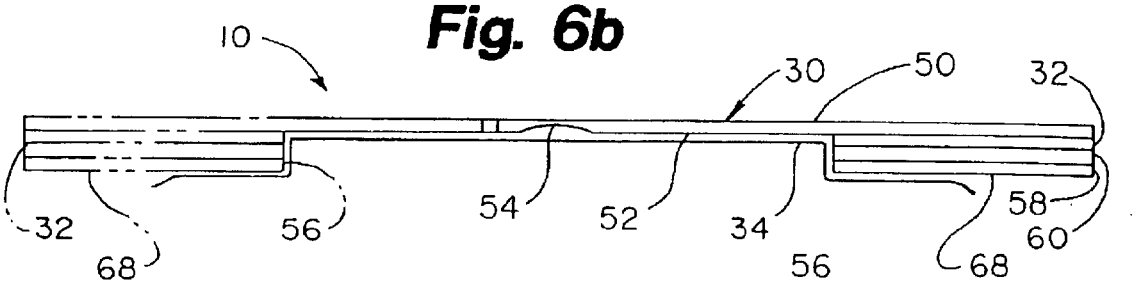
FIG. 6*b* is an end plan view of another alternate embodiment of the present invention as stored and shipped in a flat configuration.

Alternately, as depicted in FIG. 6*b* filtering fabric 34 may extend from bottom side 68 of vent panels 32, up over inner openings 56, across interior surface 52 of top panel 30, down over inner openings 56 on the opposite side and onto bottom side 68 on the opposite side. The filtering fabric 34 may be secured to interior edges 64, bottom side 68 of vent panels 32 and interior surface 52 of top panel 30 as required.

Figure 8:
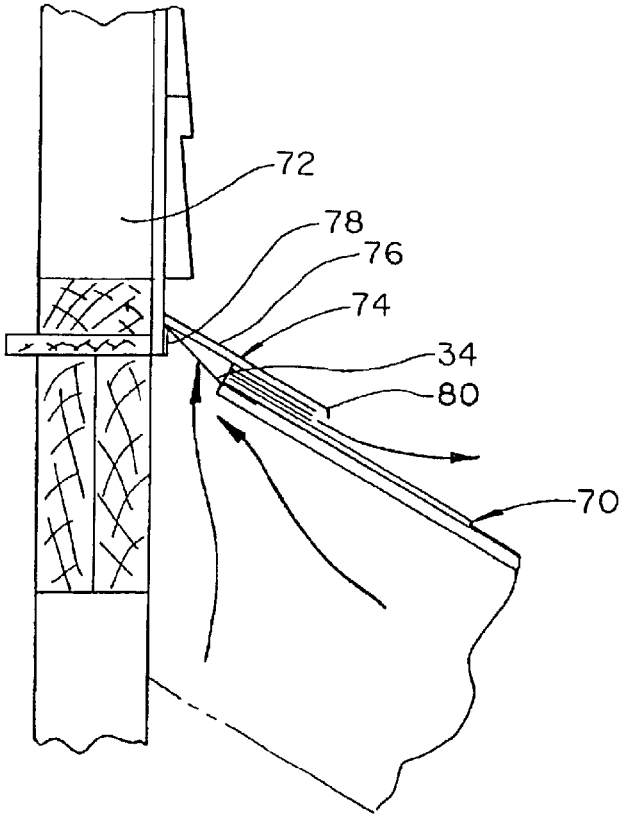
FIG. 8 is an end sectional view of an alternate embodiment of the present invention as installed on a shed roof abutting a vertical exterior wall.

FIG. 8 depicts an alternate embodiment of the ridge vent 10 adapted for use where it is desire to ventilate a shed style roof 70 in contact with an exterior wall 72. Shed roof vent 74 generally includes a generally planar top panel 76, vent panels 32 and filtering fabric 34. Planar top panel 76 includes flange panel 78 extending along its length. Vent panels 32 are disposed beneath top panel 76 and are stacked and secured in a similar fashion to ridge vent 10. Filtering fabric 34 is attached along the bottom side 68 of the lowermost vent panel 32 and to planar top panel 76 on or near flange panel 78. Filtering fabric 34 may also be attached to cover the interior edges 66 of vent panels 32 alone. Fasteners, adhesives, heat fusing or other suitable techniques may secure filtering fabric 34 to planar top panel 76 and vent panel 32. Flashing 80 may overlie the shed roof vent 74.

Referring to FIG. 1, in operation, ridge vent 10 is applied to the ridge 26 of a roof 12 over a previously made cutout 24 extending the length of the ridge 26 except for a small portion left uncut at each end of the roof 12. The cutout 24 may be larger than a cutout that would be used with a non-filtering ridge vent in order to compensate for the restriction of airflow caused by the filtering fabric 34. The ridge vent 10 is unrolled or unfolded if it is received packaged in either of these forms. The roof vent 10 is disposed so that the routed groove 54 is generally centered over the cutout 24 and the vent panels 32 are generally parallel to the shingles 22 or other roof surface. It will be appreciated by those skilled in the art that a resilient or conforming piece of material may be placed between the ridge vent 10 and the roof 12 to fill in any gaps that may be present due to any substantial irregularities in the roof structure. This may be helpful in the case of a corrugated metal or tiled roof.

Once in place, the ridge vent 12 may be secured to the roof 12 by fasteners such as nails or by adhesives. Nails may be applied directly through top panel 30 where it overlies vent panels 32 and into roof sheathing 18. A ridgeline (not shown) of shingles 22 may be applied directly over ridge vent 10.

As can be seen in FIGS. 1, and 7, when the ridge vent is installed the filtering fabric 34 forms a tent like structure. Wind blown precipitation such as rain or snow may be carried into the interior of the ridge vent 10 through airflow passages 46 but it is stopped from traveling further by the water resistant filtering fabric 34 while air may still pass. Liquid rain or melted snow that accumulates on top of the filtering fabric 34 drains from the ridge vent 10 through the lowermost layer of airflow passages 46 in vent panels 32 onto the roof 12 where it may run off shingles 22.

In the embodiment depicted in FIGS. 6*a* and 6*b*, wind blown precipitation may be carried into airflow passages 46 but is prevented from proceeding further by filtering fabric 34 and may drain back out.

Referring to FIG. 8, shed roof vent 74 is applied at the top of a shed style roof 74 where it abuts an exterior wall 72. Flange panel 78 may be bent downwardly and secured to exterior wall 72 by fasteners or adhesive. Alternately, the flange panel 78 may be bent upwardly and secured to the wall 72. Flashing 80 may be applied on top of the shed roof vent 74. Vent panels 32 may be nailed or otherwise secured to sheathing 18 through shingles 22. Any wind blown precipitation that enters the shed roof vent 74 is prevented from entering the space beneath the roof by filtering fabric 34. Rain or melted snow that accumulates on top of filtering fabric 34 drains from the shed roof vent 74 through the airflow passages 46 in the bottommost vent panel 32.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed is:

1. A venting device for a structure, comprising:

an elongate top panel portion having an interior surface and including structure defining a multiplicity of discrete air passages;

a pair of opposing ventilating portions spaced apart on the interior surface of said elongate top panel portion and defining an area of said interior surface therebetween, each of said ventilating portions having an interior side and an exterior side and formed from a weatherproof, three-ply material comprising a pair of outer plies and an intermediate ply, said outer plies and said intermediate ply defining a multiplicity of discrete air passages extending from the interior side to the exterior side; and means for filtering air passing through at least one of said multiplicities of discrete air passages, said means presenting a filtering area for air flow at least equal to the area of said interior surface defined between said pair of ventilating portions.

2. The venting device of claim 1, in which said top panel portion is formed from said three-ply material.

3. The venting device of claim 2, in which said top panel portion is characterized by a longitudinal axis and in which said top panel portion defines a route proximate to or coextensive with said longitudinal axis, said route exposing said interior openings of said multiplicity of air passages defined in said top panel portion.

4. The venting device of claim 3, in which said route is defined in one of said outer plies and in said intermediate ply.

5. The venting device of claim 1, in which said venting device is characterized by a longitudinal axis and in which said air passages extend generally transversely or generally perpendicularly to said longitudinal axis.

6. The venting device of claim 1, in which said intermediate ply is generally fluted or comprises a series of cross walls.

7. The venting device of claim 1, in which each of said ventilating portions comprises at least one panel made from said three-ply material.

8. The venting device of claim 1, in which each of said ventilating portions comprises a plurality of panels made from said three-ply material.

9. The venting device of claim 1, said air filtering means comprising a filtering material.

10. The venting device of claim 9, in which said filtering material is attached to said top panel portion or said ventilating portions.

11. The venting device of claim 10, in which said filtering material is attached by an adhesive or a fastener.

12. The venting device of claim 9, in which said top panel portion is characterized by a longitudinal axis, said filtering material attached to said top panel portion proximate said longitudinal axis.

13. The venting device of claim 1, said venting device adapted for installation on a roof structure whereby said roof structure may be ventilated.

14. A venting device for presenting air flow between the interior space of a structure and the environment, comprising:

a top panel portion having an interior surface, said top panel portion defining a multiplicity of discrete top panel air passages and presenting a top panel air flow cross section in operable air flow communication with said structure interior space;

a ventilating portion operably carried on the interior surface of said top panel portion, said ventilating rig portion defining a multiplicity of discrete ventilating portion air passages presenting a ventilating portion air flow cross section in operable air flow communication with said structure interior space, said top panel air flow cross section and said ventilating portion air flow cross section together presenting a venting device air flow area; and means for filtering air passing through said multiplicities of top panel air passages and ventilating portion air passages, said means presenting a filtering area for air flow at least equal to said venting device air flow area.

15. The venting device of claim 14, in which said top panel portion and said ventilating portion are formed from a three-ply material having a pair of generally planar outer plies and an intermediate ply, said outer plies and said intermediate ply defining substantially all of said top panel air passages and said ventilating portion air passages.

16. The venting device of claim 15, in which said intermediate ply is generally fluted or in which said intermediate ply comprises a series of cross walls extending between said pair of outer plies.

17. A ventilating device for conveying air between the interior space of a structure and the environment, comprising:

a top panel portion having an interior surface, said top panel portion including structure defining a multiplicity of discrete top panel air passages and presenting a top panel air flow cross section in operable air flow communication with said structure interior space;

a ventilating portion operably carried on the interior surface of said top panel portion, said ventilating portion defining a multiplicity of discrete ventilating portion air passages, said ventilating portion air passages presenting a ventilating portion air flow cross section in operable airflow communication with said structure interior space;

said top panel air flow cross section and said ventilating portion air flow cross section together presenting a venting device air flow area; and a filter having a first filter portion operably positioned with respect to said top panel air passages and a second filter portion operably positioned with respect to said ventilating portion air passages, said filter presenting a filtering area for air flow at least equal to said venting device air flow area.

18. The ventilating device of claim 17, in which said top panel portion and said ventilating portion are formed from a three-ply material having a pair of outer plies and an intermediate ply defining said top panel air passages and said ventilating portion air passages.

19. The ventilating device of claim 18, in which said intermediate ply is generally fluted or said intermediate ply comprises a series of cross walls.

20. The ventilating device of claim 17, in which said filter comprises a sheet of air permeable, water resistant material.

21. The ventilating device of claim 20, in which said air permeable, water resistant material comprises spun bonded randomly arranged synthetic polymer fibers.

22. A venting device for conveying an air flow from an interior space of a structure, the venting device comprising:

a top panel portion having an interior surface and defining a multiplicity of discrete top panel air passage, said top panel air passages presenting a top panel air flow cross section in fluid communication with said structure interior space;

a ventilating portion contacting the interior surface of said top panel portion and defining a multiplicity of discrete ventilating portion air passages, said ventilating portion air passages presenting a ventilating portion air flow cross section in fluid communication with said structure interior space, said top panel air flow cross section and said ventilating portion air flow cross section together presenting a venting device air flow area; and a filtering material disposed to contact said air flow as said air flow enters said venting device from said interior space of said structure and presenting a filtering material area at least equal to said venting device air flow area.

23. The venting device of claim 22, in which each of said top panel portion and said ventilating portion comprises a weather proof three-ply material, said three-ply material comprising a par of generally planar outer plies and an intermediate ply disposed between said outer plies, said outer plies and said intermediate ply defining said top panel air passages and said ventilating portion air passages.

24. The venting device of claim 22, in which said filtering material is attached to said top panel portion or said ventilating portion.

25. The venting device of claim 22, in which said top panel portion is characterized by a longitudinal axis, said filtering material attached to said top panel proximate said longitudinal axis.

26. The venting device of claim 22, in which said ventilating portion comprises a plurality of panels made from a three-ply material, said three-ply material comprising a pair of outer plies and an intermediate ply disposed between said outer plies.

27. The venting device of claim 22, in which said filtering material comprises a sheet of air permeable, water resistant material.

28. The venting device of claim 27, in which said air permeable, water resistant material comprises spun bonded randomly arranged synthetic polymer fibers.

29. A venting device for conducting an air flow between the interior space of a structure and the environment, comprising;

a top panel portion having an interior surface;

a ventilating portion attached to the interior surface of said top panel portion, said ventilating portion defining a multiplicity of discrete ventilating portion air passages, said multiplicity of discrete ventilating portion air passages comprising a first row of ventilating portion air passages and a second row of ventilating portion air passages underlying said first row of ventilating portion air passages, said first and second rows of ventilating air passages generally parallel to said top panel portion, a cross-sectional area of said top panel portion and a cross-sectional area of said ventilating portion together presenting a venting device air flow area; and a filtering material disposed to contact air entering said venting device from said interior space of said structure and having a surface area at least equal to said venting device air flow area.

30. The venting device of claim 29, in which said top panel portion defines a multiplicity discrete of top panel portion air passages extending generally parallel to said multiplicity of ventilating portion air passages.

31. The venting device of claim 30, in which said top panel portion and said ventilating portion are formed from a three-ply material comprising a pair of outer plies and an intermediate ply disposed between said pair of outer plies, said outer plies and said intermediate ply defining said multiplicity of top panel portion air passages and said multiplicity of ventilating portion air passages.

32. The venting device of claim 31, in which said intermediate ply is generally fluted or in which said intermediate ply comprises a series of cross walls.

33. The venting device of claim 29, in which said filtering material comprises a sheet of air permeable, water resistant material.

* * * * *

UNITED STATES PATENT AND TRADEMARK OFFICE

CERTIFICATE OF CORRECTION

PATENT NO. : 6,913,530 B2
DATED : July 5, 2005
INVENTOR(S) : Morris et al.

It is certified that error appears in the above-identified patent and that said Letters Patent is hereby corrected as shown below:

Column 1,
Line 27, delete “reduce” and insert -- reduced --.

Column 4,
Lines 10 and 12, after “view” insert -- of --.

Column 5,
Line 35, delete “desire” and insert -- desired --.

Column 7,
Line 40, delete “rig”.

Column 8,
Line 9, delete “airflow” and insert -- air flow --.
Line 57, delete “par” and insert -- pair --.

Signed and Sealed this

Thirtieth Day of August, 2005

JON W. DUDAS
*Director of the United States Patent and Trademark Office*